US007185972B2

(12) United States Patent
Tanikawa et al.

(10) Patent No.: US 7,185,972 B2
(45) Date of Patent: Mar. 6, 2007

(54) METHOD OF MANUFACTURING PRINTER HEAD, AND METHOD OF MANUFACTURING ELECTROSTATIC ACTUATOR

(75) Inventors: Toru Tanikawa, Kanagawa (JP); Iwao Ushinohama, Kanagawa (JP)

(73) Assignee: Sony Corporation, Tokyo (JP)

( * ) Notice: Subject to any disclaimer, the term of this patent is extended or adjusted under 35 U.S.C. 154(b) by 250 days.

(21) Appl. No.: 10/467,975

(22) PCT Filed: Feb. 14, 2002

(86) PCT No.: PCT/JP02/01230

§ 371 (c)(1),
(2), (4) Date: Jan. 29, 2004

(87) PCT Pub. No.: WO02/064373

PCT Pub. Date: Aug. 22, 2002

(65) Prior Publication Data

US 2004/0115844 A1 Jun. 17, 2004

(30) Foreign Application Priority Data

Feb. 16, 2001 (JP) ..... 2001-039713

(51) Int. Cl.
*B41J 2/16* (2006.01)

(52) U.S. Cl. ..... 347/71; 216/27; 29/890.1; 438/21

(58) Field of Classification Search ..... 216/27; 347/54, 68, 69, 71
See application file for complete search history.

(56) References Cited

U.S. PATENT DOCUMENTS

| | | | | |
|---|---|---|---|---|
| 5,984,447 | A | 11/1999 | Ohashi | |
| 6,357,865 | B1 * | 3/2002 | Kubby et al. | 347/68 |
| 6,367,915 | B1 * | 4/2002 | Gooray et al. | 347/54 |
| 6,662,448 | B2 * | 12/2003 | Kubby et al. | 29/890.1 |

FOREIGN PATENT DOCUMENTS

| | | | |
|---|---|---|---|
| JP | 07-214769 | * | 8/1995 |
| JP | 08-300650 | | 11/1999 |
| JP | 11-314363 | | 11/1999 |
| JP | 2002-240274 | * | 8/2002 |
| JP | 2003-276194 | * | 9/2003 |

OTHER PUBLICATIONS

English translation of JP 11-314363.*

* cited by examiner

*Primary Examiner*—Huan Tran
(74) *Attorney, Agent, or Firm*—Sonnenschein Nath & Rosenthal LLP

(57) ABSTRACT

After a movable electrode is formed on a sacrificial layer on a fixed electrode, the sacrificial layer is removed to form a space between the fixed electrode and the movable electrode. Thus, simple and accurate manufacture as well as simple integration of, for example, a driving circuit can be achieved.

2 Claims, 7 Drawing Sheets

INK DROPLET
11
12
13
15
16
17
18, 20
21
22
23
32

METHOD OF MANUFACTURING PRINTER HEAD, AND METHOD OF MANUFACTURING ELECTROSTATIC ACTUATOR

BACKGROUND OF THE INVENTION

The present invention relates to a printer head of, for example, an inkjet printer and to an electrostatic actuator applicable to such a printer head.

A conventional inkjet printer ejects ink droplets on paper by driving a heater element or a piezoelectric element to print an image. Japanese Unexamined Patent Application Publication No. 10-315466, for example, discloses such a method in which the driving is performed by an electrostatic actuator.

FIG. 1 is a cross-sectional view of the printer head having the electrostatic actuator. The printer head 1 includes a predetermined substrate 2 whose surface has recesses formed thereon at a given pitch. Each recess has an electrode 3 on the bottom thereof. The printer head 1 also includes a component 5 having bottom plates 6 and partitions of ink liquid cells 4 on the substrate 2. The component 5 formed of a conductive material is disposed over the electrodes 3. The electrodes 3 disposed on the substrate 2 face the bottom plates 6 of the respective ink liquid cells with the distance therebetween being defined by the recesses of the substrate 2 so that the component 5 is insulated from the electrodes 3. The bottom plates 6 of the component 5 have a predetermined thickness so as to function as a diaphragm. Another component 8 having nozzles 7 is disposed over the component 5.

In this printer head 1 having the above-mentioned structure, when a voltage is applied to the space between the component 5 and one of the electrodes 3, the corresponding bottom plate 6 is attracted and bent towards the electrode 3. When the application of the voltage is stopped, the bottom plate 6 is restored to its original state. Accordingly, the application of the voltage generates an electrostatic force between the electrode 3 and the component 5 to change the volume in the ink liquid cell 4 of the printer head 1. The pressure generated by the decreased volume of the ink liquid cell 4 ejects ink from one of the nozzles 7.

An inkjet printer having a heater element requires large electric power for driving the heater element. Thus, the entire unit consumes a large amount of power. On the other hand, an inkjet printer having a piezoelectric element has difficulties with the integration of the piezoelectric elements, leading to a complicated manufacturing process. For these reasons, various kinds of methods have been presented to solve these problems and also to improve the level of performance in inkjet printers having the heater element or the piezoelectric element.

In contrast to the inkjet printer having the heater element or the piezoelectric element, the printer head having the electrostatic actuator still has possibilities for further improvements and may solve the problems residing in the inkjet printer having the heater element or the piezoelectric element.

As mentioned above, in the conventional printer head having the electrostatic actuator, the component 5 having the bottom plates 6 and the partitions of the ink liquid cells 4 and the component 8 having nozzles 7 are stacked on the substrate 2 in that order. This assembly process, however, is complicated. This process also impairs the precision in the positioning of the component 5 and the component 8, and may cause ink leakage among the substrate 2, the component 5, and the component 8. Because the component 5 is disposed on the substrate 2, the connecting faces of the substrate 2 and the component 5 must be planarized. This causes problems with integration of a driving circuit of the electrostatic actuator on the substrate 2.

SUMMARY OF THE INVENTION

The present invention provides a simple and accurate method of manufacturing an electrostatic actuator and a printer head that allows simple integration of, for example, a driving circuit.

To solve the above-mentioned problems, the present invention provides a method of manufacturing a printer head including a fixed-electrode formation step for forming a fixed electrode on a predetermined substrate; a sacrificial-layer formation step for forming a sacrificial layer on the fixed electrode; a movable-electrode formation step for forming the movable electrode on the sacrificial layer; and a sacrificial-layer removal step for removing the sacrificial layer to form a space between the fixed electrode and the movable electrode.

After the fixed electrode, the sacrificial layer, and the movable electrode are formed in that order, the sacrificial layer is removed by the sacrificial-layer removal step to form the space between the fixed electrode and the removable electrode. These steps are performed using a semiconductor fabricating process. Thus, simple manufacture and positioning with high precision are achieved. Furthermore, an intergrated circuit, such as the driving circuit, can be preliminarily formed on the substrate. Accordingly, simple and accurate manufacture as well as simple integration of, for example, the driving circuit can be achieved.

The present invention is also applied a method of manufacturing an electrostatic actuator, including a fixed-electrode formation step for forming a fixed electrode on a predetermined substrate; a sacrificial-layer formation step for forming a sacrificial layer on the fixed electrode; a movable-electrode formation step for forming the movable electrode on the sacrificial layer; and a sacrificial-layer removal step for removing the sacrificial layer to form a space between the fixed electrode and the movable electrode.

After the fixed electrode, the sacrificial layer, and the movable electrode are formed in that order, the sacrificial layer is removed by the sacrificial-layer removal step to form the space between the fixed electrode and the movable electrode. These steps are performed using a semiconductor fabricating process. Thus, simple manufacture and positioning with high precision are achieved. Furthermore, an integrated circuit, such as the driving circuit, can be preliminarily formed on the substrate. Accordingly, a method of manufacturing an electrostatic actuator that enables simple and accurate manufacture as well as simple integration of, for example, the driving circuit is provided.

DETAILED DESCRIPTION OF THE PRESENTLY PREFERRED EMBODIMENTS

Embodiments of the present invention will now be described with reference to the drawings.

(1) First Embodiment (1-1)Structure of First Embodiment

Figure 1:
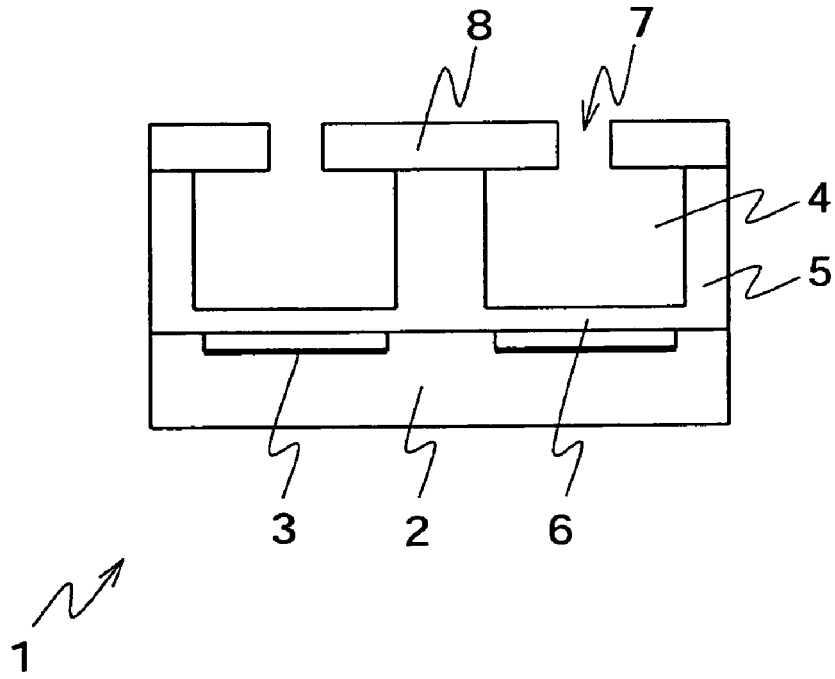
FIG. 1 is a cross-sectional view of a conventional printer head.
Figure 2:
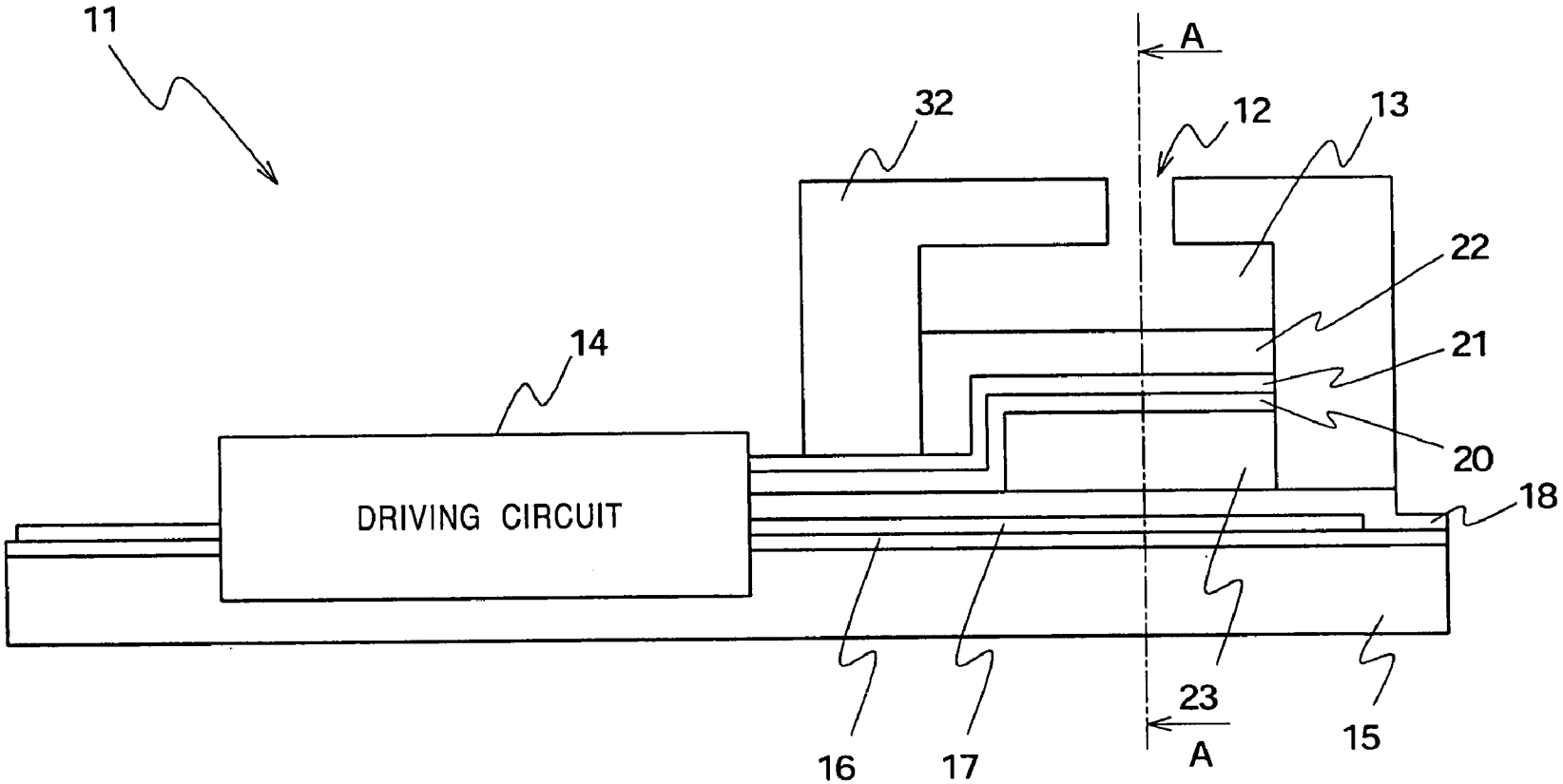
FIG. 2 is a cross-sectional view of a printer head according to an embodiment of the present invention.
Figures 3A, 3B, 3C:
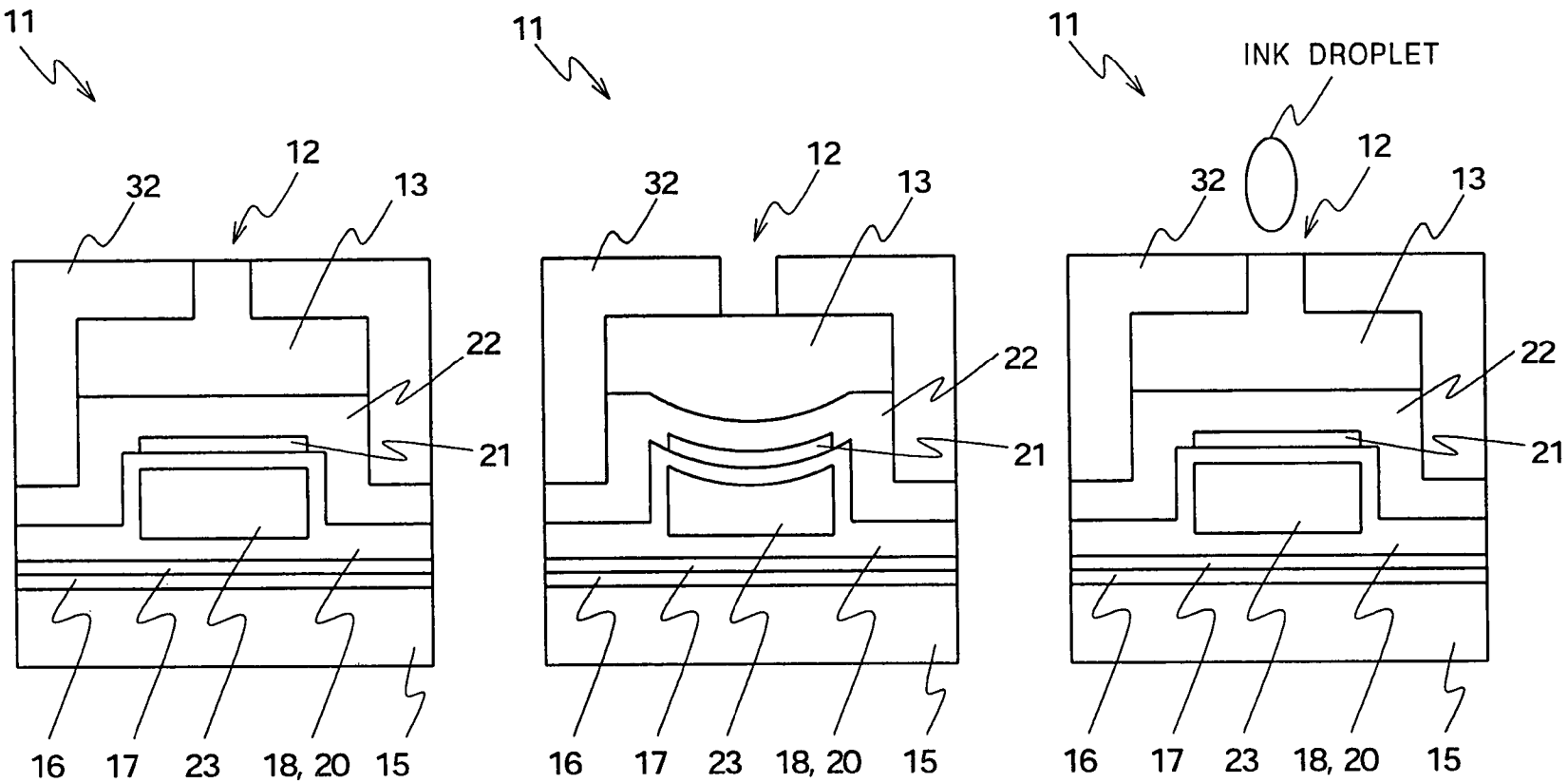
FIG. 3(A) to FIG. 3(C) are cross-sectional views taken along line A—A of the printer head of FIG. 2.

FIG. 2 is a cross-sectional view of a printer head according to a first embodiment of the present invention, the cross-sectional view being taken along an imaginary line extending through the center of one of a plurality of nozzles 12 arrayed in a row. FIG. 3(A) to FIG. 3(C) are cross-sectional views taken along line A—A of FIG. 2.

A printer head 11 is a line head used in a line printer. The nozzles 12 arrayed in a row have a length equivalent to the width of paper used for printing such that the nozzles 12 are arrayed in a long line. An electrostatic actuator of the printer head 11 changed the pressure in each ink liquid cell 13. The electrostatic actuator is driven by an electrostatic force to eject ink droplets from each nozzle 12. Also, ink is introduced to the ink liquid cell 13 through an ink channel that is not shown in the drawing. The printer head 11 is formed by stacking head components on a substrate 15 in a predetermined order by a semiconductor fabricating process.

Figure 4A:
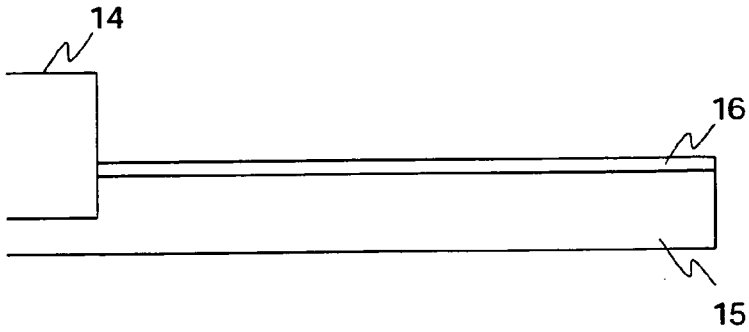
FIG. 4(A) to FIG. 4(D) are cross-sectional views of the printer head of FIG. 2, illustrating the formation steps of an electrostatic actuator.

FIG. 4(A) through FIG. 7(M) are cross-sectional views for describing the formation steps of the printer head 11 in conjunction with FIG. 2. In the printer head 11, a driving circuit 14 is preliminarily formed on the substrate 15. As shown in FIG. 4(A), an insulating layer 16 is then formed on the substrate 15 by, for example, chemical vapor deposition (CVD) and annealing. The insulating layer 16 is, for example, a silcon oxide film or a silcon nitride film.

Figure 4B:
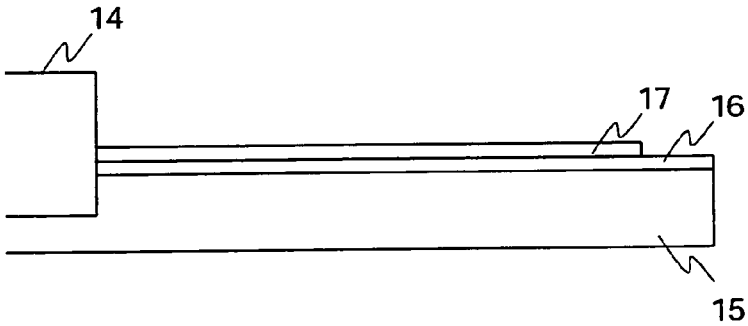

Referring to FIG. 4(B), after the formation of the insulating layer 16 in the printer head 11, a fixed-electrode electrode formation step is performed to form a fixed electrode 17 for the electrostatic actuator. In other words, the printer head 11 is processed by sputtering or vapor deposition to form a conductive layer with a predetermined pattern. Thus, the fixed electrode 17 is formed. The conductive layer is a metallic film composed of, for example, aluminum, gold, or platinum. The fixed electrode 17 is connected with a region in the driving circuit 14 via an interconnection pattern formed simultaneously in this formation step.

Figure 4C:
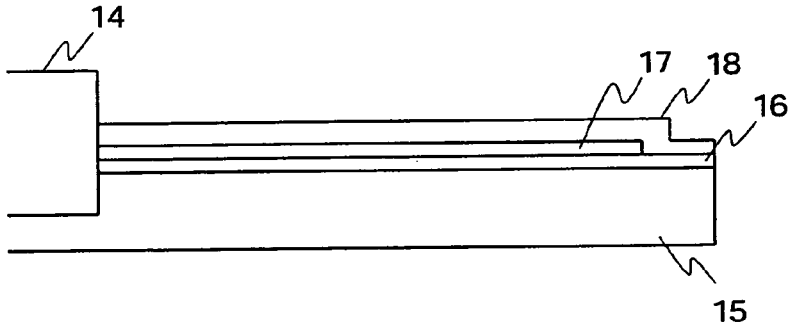

Referring to FIG. 4(C), an insulating layer 18 is formed in the printer head 11 at a predetermined thickness. The insulating layer 18 is, for example, a silicon oxide film or a silicon nitride film.

Figure 4D:
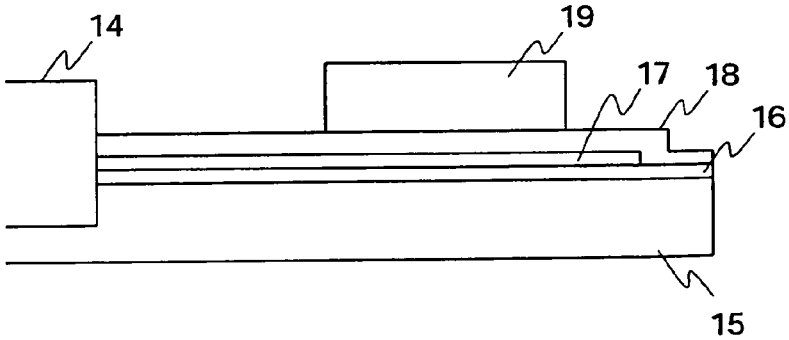

Referring to FIG. 4(D), a sacrificial layer 19 is formed in the printer head 11 by a sacrificial-layer formation step. The sacrificial layer 19 functions as a dummy layer and will be removed after a movable electrode facing the fixed electrode 17 is formed. The sacrificial layer 19 is used for creating a space between the fixed electrode 17 and the movable electrode. The sacrificial layer 19 composed of, for example, polysilicon, a metallic material, or an insulating material is formed a predetermined thickness. The excess of the layer 19 is then removed by, for example, photolithography. The removal of the sacrificial layer 19 after the formation of the movable electrode must not have any effect on other components. In other words, the selectivity of etching the sacrificial layer 19 from the other components must be sufficiently maintained. A wide variety of materials may be used for the sacrificial layer 19 as long as such selectivity that does not impair the practical use is achieved.

Figure 5E:
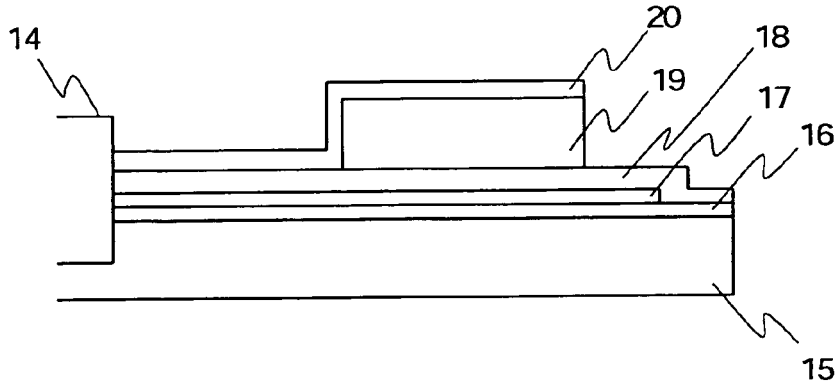
FIG. 5(E) to FIG. 5(H) are cross-sectional views of the subsequent formation steps following the step in FIG. 4(D).
Figure 5F:
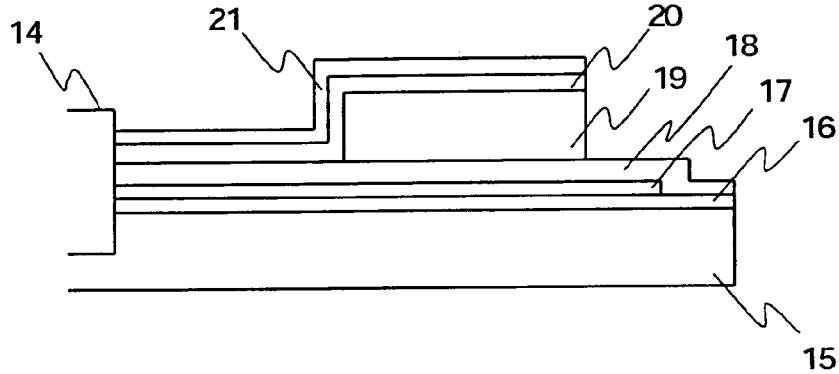

Referring to FIG. 5(E), after the sacrificial layer 19 is formed in the printer head 11, an insulating layer 20 of, for example, silicon oxide or silicon nitride is formed. Referring to FIG. 5(F), a movable electrode 21 is then formed by a movable-electrode formation step. As in the formation of the fixed electrode 17, the movable electrode 21 is also formed with the conductive layer of a metallic film composed of, for example, aluminum, gold, or platinum. The conductive layer with a predetermined pattern is formed by, for example, sputtering or vapor deposition. The movable electrode 21 is connected with a region in the driving circuit 14 via an interconnection pattern formed simultaneously in this formation step.

Figure 5G:
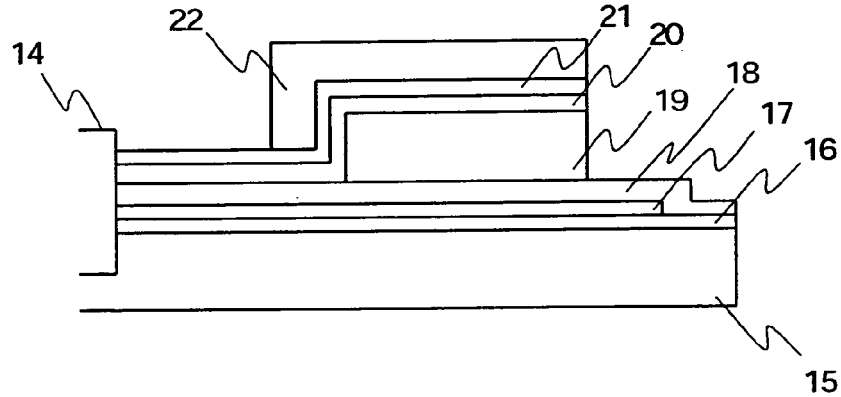

Referring to FIG. 5(G), in a diaphragm formation step, a diaphragm 22 is formed on the movable electrode 21 of the printer head 11. For the diaphragm 22, a rigid material that is not brittle and that has high Young's modulus and toughness is used. In detail, the diaphragm 22 is formed on the movable electrode 21 by using, for example, a ceramic material composed of, for example, a silicon oxide film, a silicon nitride film, silicon, a metallic film, alumina, or zirconia. If the diaphragm 22 is composed of a metallic material, the diaphragm 22 may also function as the movable electrode 21.

Figure 5H:
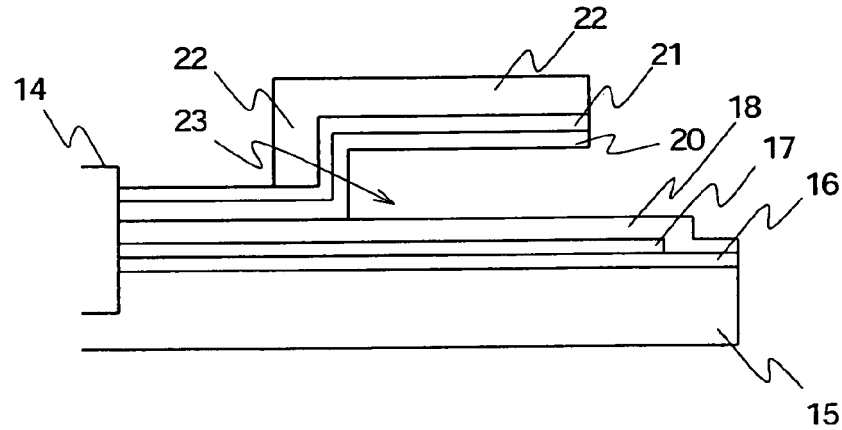

Referring to FIG. 5(H), the sacrificial layer 19 in the printer head 11 is removed by a sacrificial-layer removal step. Thus, a space 23 having the same thickness of the sacrificial layer 19 is formed between the fixed electrode 17 and the movable electrode 21. Depending on the material of the sacrificial layer 19, etching processes, such as dry-etching or wet-etching, may be applied for this removal step.

Through these steps, the electrostatic actuator having the fixed electrode 17 and the movable electrode 21 facing each other with the predetermined space 23 therebetween is formed on the semiconductor 15 of the printer head 11.

Figure 6I:
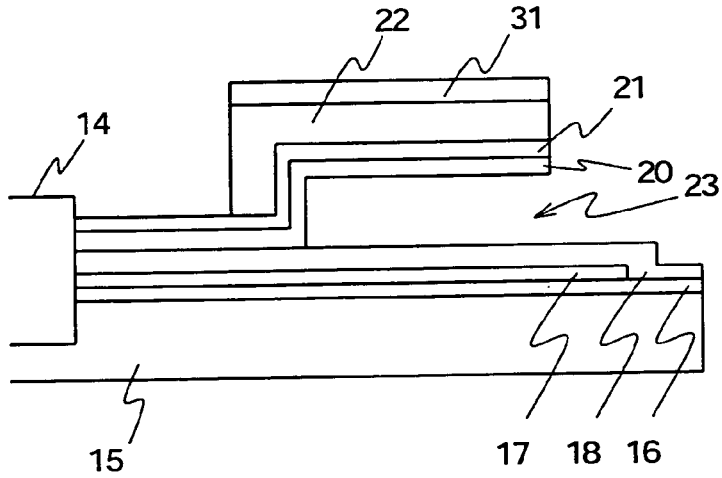
FIG. 6(I) to FIG. 6(K) are cross-sectional views of the subsequent formation steps following the step in FIG. 5(H).

If necessary, a protective layer composed of, for example, silicon nitride is formed on the diaphragm of the printer head 11. Referring to FIG. 6(I), another sacrificial layer 31 is formed according to the patterns of the ink channel and the ink liquid cell. The sacrificial layer 31 is removed after stacking of, for example, partition components that form the ink liquid cell and the ink channel. Consequently, the sacrificial layer 31 is used for creating spaces for the ink liquid cell and the ink channel.

The thickness of the sacrificial layer 31 is lower than the height of the ink channel and the ink liquid cell and is made highly uniform by the semiconductor fabricating process. The sacrificial layer 31 is composed of a material that can expand the volume of the sacrificial layer 31 by a certain reaction process so that the increased thickness becomes equivalent to the height of the ink channel and the ink liquid cell. In this embodiment, this reaction process is performed by heating a foamable material (referred to as a foamable resist hereinafter) that forms the sacrificial layer 31. In other words, a mixture of a foaming agent that generates gas during the reaction process and a predetermined base material that forms a layer of foam is used to form the sacrificial layer 31.

In detail, azobisisobutyronitrile (product name: VINYFOR AZ, decomposition temperature: 114° C., manufacturer: EIWA CHEMICAL IND. CO., LTD.) was used for the foaming agent and a positive resist (product name: PFR- 9500G, manufacturer: JSR) was used for the base material. In this embodiment, 1 part of the foaming agent was added to 49 parts of the base material. These materials were thoroughly stirred and mixed together. Thus, a foamable resist that satisfies the above-mentioned conditions was formed.

After the foamable resist was spin-coated, the printer head 11 was cured at 80° C., was exposed with light, and was developed to form the sacrificial layer 31.

Figure 6J:
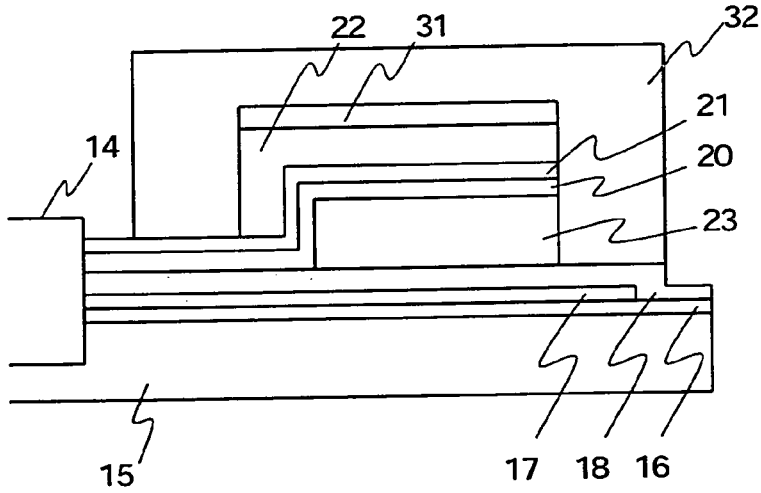

Referring to FIG. 6(J), a photosensitive epoxy is supplied to the printer head 11 by spin-coating and is cured under given conditions to form a coating layer 32 by the gelation of the photosensitive epoxy. The coating layer 32 having a predetermined thickness covers the entire sacrificial layer 31. The coating layer 32 forms the ink channel, the ink liquid cell, and the nozzle. In this embodiment, the curing temperature of the selected material used for the coating layer 32 is lower than the foaming temperature of the sacrificial layer 31. Furthermore, the curing temperature of the material is higher than its foaming temperature.

Figure 6K:
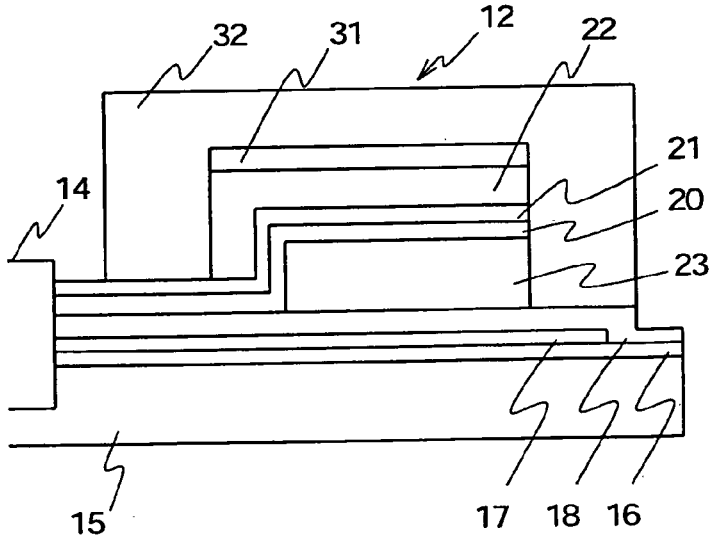

Referring to FIG. 6(K), an exposure process is performed to determine the shape of a nozzle 12 in the printer head 11.

Figure 7L:
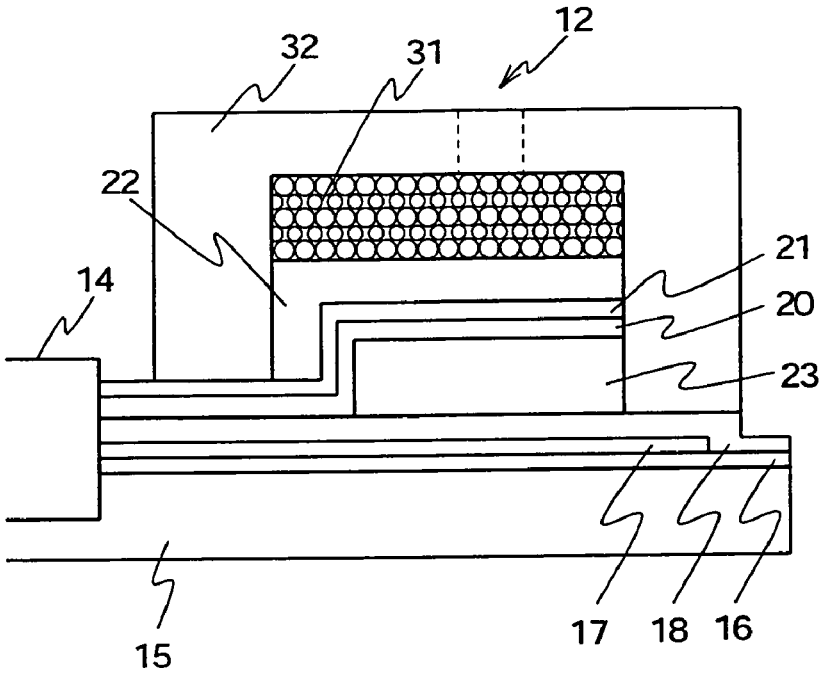
FIG. 7(L) to FIG. 7(M) are cross-sectional views of the subsequent formation steps following the step in FIG. 6(K).

The printer head 11 is then heat-treated at 130° C. for 10 minutes for a reaction process. Referring to FIG. 7(L), the temperature rise by this reaction process foams the material of the sacrificial layer 31. The thickness of the sacrificial layer 31 thus increases to the thickness of the ink liquid cell 13. After this increase in thickness of the sacrificial layer 31, the curing of the coating layer 32 is completed. Accordingly, the sacrificial layer 31 containing a large number of bubbles forms the structure of the ink channel and the ink liquid cell in the printer head 11, and the entire structure is covered with the cured coating layer 32.

Figure 7M:
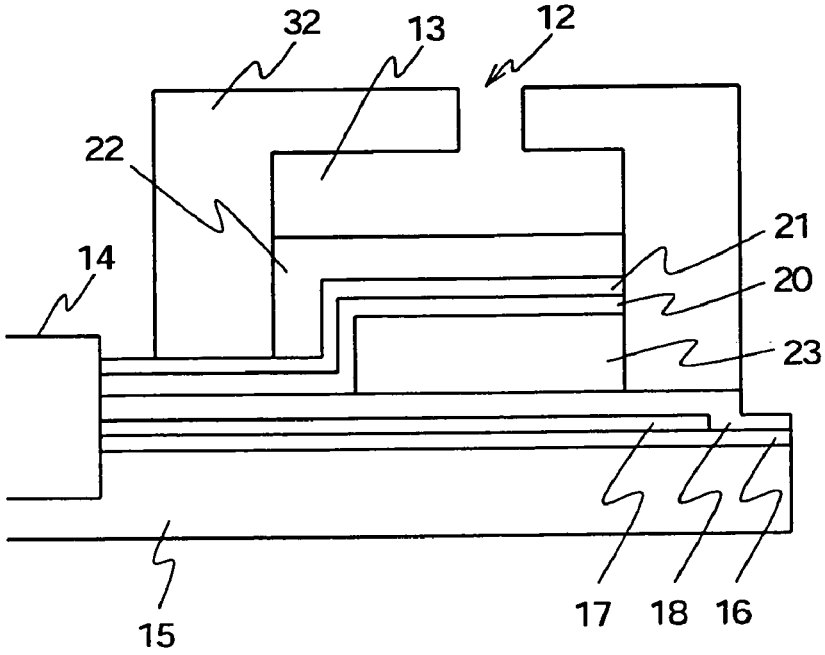

After a portion of the epoxy material is removed from the coating layer 32 to form the nozzle 12 in the printer head 11, the rear surface of the semiconductor substrate 15 is patterned by a resist process. An ink-supplying hole (not shown in the drawings) leading towards the ink channel is formed in the rear surface of the semiconductor substrate 15 by chemical anisotropic etching. Referring to FIG. 7(M), the sacrificial layer 31 is removed from the ink-supplying hole and the nozzle 12 using methanol as a solvent by a removal step. Thus, the ink liquid cell 13 and the ink channel are formed in the printer head 11.

The semiconductor substrate 15 of the printer head 11 is cut into chips using a dicing saw. Each of the chips is mounted on a given component and is connected to an ink cartridge via the ink-supplying hole. Furthermore, pads of the driving circuit on the semiconductor substrate 15 formed by wire-bonding are connected to predetermined regions. Thus, the printer head 11 is completed.

(1-2) Operation of First Embodiment

In the printer head 11 (referring to FIG. 2 and FIG. 3(A)), when a predetermined voltage is applied between the fixed electrode 17 and the movable electrode 21, the electrostatic force generated between the fixed electrode 17 and the movable electrode 21 attracts the movable electrode 21 towards the fixed electrode 17 (referring to FIG. 3(A) and FIG. 3(B)). This increases the volume of the ink liquid cell 13 and introduces ink to the ink liquid cell 13 via the ink channel that is not shown in the drawings. Also in the printer head 11, when the application of the voltage between the movable electrode 21 and the fixed electrode 17 is stopped, the electrostatic force between the movable electrode 21 and the fixed electrode 17 is removed. The ink liquid cell 13 regains its original volume by the restoring force of the diaphragm 22 and the movable plate 21. Thus, the pressure in the ink liquid cell 13 is increased to eject an ink droplet from the nozzle 12 of the printer head 11 (FIG. 3(C)). In the printer head 11, the electrostatic actuator formed of the fixed electrode 17 and the movable electrode 21 face each other with a predetermined distance therebetween. The driving of this electrostatic actuator ejects an ink droplet from the nozzle 12.

In the printer head 11 having the above-mentioned operation (referring to FIG. 4(A) to FIG. 5(J)), the insulating layer 16 is formed on the semiconductor substrate 15, then the fixed electrode 17, the insulating layer 18, the sacrificial layer 19, the movable electrode 21, and the diaphragm 22 are formed in that order. Next, the sacrificial layer 19 is removed so that the space 23 required for the operation of the movable electrode 21 is formed between the fixed electrode 17 and the movable electrode 21. Accordingly, the electrostatic actuator is formed in the printer head 11 by the semiconductor fabricating process. In the printer head 11, the components, such as the fixed electrode and the diaphragm, are formed by a semiconductor fabricating process with precise positioning to allow simple and accurate manufacture of the electrostatic actuator. Because the electrostatic actuator is formed on the semiconductor substrate 15, the driving circuit 14 can be preliminarily formed on the semiconductor substrate 15. This also simplifies the formation steps. On the other hand, if the driving circuit is formed separately, the fixed electrode and the movable electrode of each ink liquid cell must be connected to the driving circuit, requiring a longer time for the manufacture. In this embodiment, however, the electrostatic actuator is formed after the driving circuit 14 is preliminarily formed on the semiconductor substrate 15, thereby preventing, for example, contamination by impurities during the formation of the driving circuit 14. This achieves a simple manufacturing process of the electrostatic actuator.

After the formation of the sacrificial layer 19 by the semiconductor fabricating process, the sacrificial layer 19 is removed to form the space 23 between the movable electrode 21 and the fixed electrode 17, whereby the space 23 is provided with a predetermined height with high precision. The difference in driving force of the electrostatic actuator can thus be reduced so as to reduce the irregularity in volume of ink in the printer head 11.

Furthermore, because the diaphragm 22 is formed by a deposition process, the thickness can be precisely controlled so that any irregularity in the thickness is reduced.

After the electrostatic actuator is formed in the printer head 11, the sacrificial layer 31 and the coating layer 32 are formed using a similar semiconductor fabricating process. The coating layer 32 is then exposed with light through a nozzle pattern (FIG. 6(K)). The sacrificial layer 31 is foamed such that the height of the ink liquid cell 13 is maintained. The coating layer 32 is then cured and the sacrificial layer 31 is removed.

After the electrostatic actuator is formed in the printer head 11, the semiconductor fabricating process can be used for subsequent fabrications. This allows highly-precise positioning of, for example, the nozzle 12. Furthermore, this prevents problems, such as ink leakage between components, to achieve simple and accurate manufacture.

After the sacrificial layer 31 is foamed and the height of the ink liquid cell 13 is maintained, the coating layer 32, which is a component forming the ink liquid cell, is cured. The foamed sacrificial layer 31 is then removed so that the ink liquid cell 13 is formed. This allows a reduction in time for the removal of the sacrificial layer and forms the ink liquid cell 13 with high precision.

(1-3) Advantages of the First Embodiment

The above structure achieves a printer head which allows simple integration of a driving circuit. This printer head can be simply and accurately manufactured by forming a sacrificial layer and a movable electrode on a fixed electrode, and then removing the sacrificial layer to form a space between the fixed electrode and the movable electrode.

Furthermore, after a mold that corresponds to an ink liquid cell space and an ink channel space, which introduces ink to the ink liquid cell, are formed with the sacrificial layer, a coating layer that forms the partitions of the ink liquid cell and the ink channel is disposed over the mold. The mold, that is, the sacrificial layer is then removed. Consequently, the semiconductor fabricating process can be applied to the formation of, for example, the ink liquid cell, which is the object to be driven by the electrostatic actuator. This also achieves simple and accurate manufacture of the printer head.

In particular, because the substrate is composed of silicon, a semiconductor fabricating process can be readily applied. Furthermore, simple integration of, for example, the driving circuit can be achieved.

In other words, by preliminarily forming the driving circuit on the substrate for applying a voltage between the fixed electrode and the movable electrode, the driving circuit can be readily integrated.

(2) Other Embodiments

In the above-mentioned embodiment, the printer head formed on the semiconductor substrate composed of silicon was described. The present invention, however, is not limited to this material and a wide variety of materials may be used for the substrate as desired. For example, a glass substrate may be used in place of the silicon substrate. When using the glass substrate, a thin film transistor is formed for the driving circuit so that the driving circuit can be integrated. Furthermore, when using the glass substrate, a plurality of printer heads is formed together on a rectangular glass substrate. The printer heads can then be individually separated so that each printer head may be used for a printer head having an elongated structure, such as a line head. In contrast to the circular silicon substrate, the rectangular glass substrate can efficiently provide a large number of printer heads from one substrate.

In the above-mentioned embodiment, the semiconductor fabricating process was applied to the printer head to form, for example, the ink liquid cell. The present invention, however, is not limited to this process. As desired, components, such as the ink liquid cell, may be formed by bonding a resin material having the same shape as the ink liquid cell or the ink channel.

Although the driving circuit is integrated with the printer head in the above-mentioned embodiment, the present invention may alternatively allow the driving circuit to be separated as an individual component.

Although the above-mentioned embodiment of the present invention is applied to the printer head, the application of the present invention is not limited to the printer head and may be used as an electrostatic actuator in a variety of elements and devices.

As in the present invention described above, after the formation of the movable electrode on the sacrificial layer formed on the fixed electrode, the sacrificial layer is then removed to create a space between the fixed electrode and the movable electrode. Thus, a simple and accurate method of manufacturing a printer head that allows simple integration of, for example, a driving circuit is provided. Furthermore, a simple and accurate method of manufacturing an electrostatic actuator applicable to such a printer head is achieved.

INDUSTRIAL APPLICABILITY

The present invention relates to a method of manufacturing a printer head and a method of manufacturing an electrostatic actuator, and is applicable to an inkjet printer.

The invention claimed is:

1. A method of manufacturing a printer head which changes the volume of an ink liquid cell by moving a movable electrode to eject an ink droplet from a predetermined nozzle, the movable electrode being moved by electrostatic force generated between a fixed electrode and a movable electrode, the method comprising:

a fixed-electrode formation step for forming the fixed electrode on a predetermined substrate;

a sacrificial-layer formation step for forming a sacrificial layer on the fixed electrode;

a movable-electrode formation step for forming the movable electrode on the sacrificial layer; and a sacrificial-layer removal step for removing the sacrificial layer to form a space between the fixed electrode and the movable electrode;

a mold formation step for forming a mold on the top surface of the movable electrode, the mold corresponding to at least a space for the ink liquid cell and a space for an ink channel that introduces ink to the ink liquid cell;

a deposition step for depositing a coating material that forms partitions of the ink liquid cell and the ink channel and a coating material that forms a partition of a nozzle to cover the mold; and a mold-removal step for removing the mold after the formation of the partitions using the coating material, wherein the mold is formed of a foamable material that expands to determine the volume of the ink liquid cell during the mold-removal step.

2. A method of manufacturing a printer head which changes the volume of an ink liquid cell by moving a movable electrode to eject an ink droplet from a predetermined nozzle, the movable electrode being moved by electrostatic force generated between a fixed electrode and a movable electrode, the method comprising:

a fixed-electrode formation step for forming the fixed electrode on a predetermined substrate;

a sacrificial-layer formation step for forming a sacrificial layer on the fixed electrode;

a movable-electrode formation step for forming the movable electrode on the sacrificial layer; and a sacrificial-layer removal step for removing the sacrificial layer to form a space between the fixed electrode and the movable electrode;

a mold formation step for forming a mold on the top surface of the movable electrode, the mold corresponding to at least a space for the ink liquid cell and a space for an ink channel that introduces ink to the ink liquid cell;

a deposition step for depositing a coating material that forms partitions of the ink liquid cell and the ink channel and a coating material that forms a partition of a nozzle to cover the mold; and a mold-removal step for removing the mold after the formation of the partitions using the coating material, wherein the coating material for forming the partitions of the ink liquid cell and the ink channel and the coating material for forming the partition of the nozzle are formed of a thermosetting material and are thermally cured during the mold-removal step to form the partitions.

* * * * *